US011480924B2

(12) United States Patent
Sato

(10) Patent No.: US 11,480,924 B2
(45) Date of Patent: Oct. 25, 2022

(54) ESCAPE LEVER, MOVEMENT, AND TIMEPIECE

(71) Applicant: Seiko Epson Corporation, Tokyo (JP)

(72) Inventor: Tadashi Sato, Shiojiri (JP)

(73) Assignee: SEIKO EPSON CORPORATION

( * ) Notice: Subject to any disclaimer, the term of this patent is extended or adjusted under 35 U.S.C. 154(b) by 600 days.

(21) Appl. No.: 16/529,948

(22) Filed: Aug. 2, 2019

(65) Prior Publication Data

US 2020/0041960 A1 Feb. 6, 2020

(30) Foreign Application Priority Data

Aug. 3, 2018 (JP) ..... JP2018-146411

(51) Int. Cl.

*G04B 15/00* (2006.01)
*G04B 15/14* (2006.01)
*G04B 13/02* (2006.01)

(52) U.S. Cl.

CPC ..... *G04B 15/14* (2013.01); *G04B 13/027* (2013.01)

(58) Field of Classification Search

CPC ..... G04B 17/285; G04B 31/00; G04B 15/00; G04B 15/14; G04B 13/027

See application file for complete search history.

(56) References Cited

U.S. PATENT DOCUMENTS

| | | | | |
|---|---|---|---|---|
| 8,529,122 | B2 * | 9/2013 | Cettour-Baron | G04B 15/08 368/131 |
| 9,323,220 | B2 * | 4/2016 | Tu | G04B 15/14 |
| 2015/0323901 | A1 | 11/2015 | Dubois et al. | |
| 2015/0331391 | A1 | 11/2015 | Dubois et al. | |
| 2016/0161915 | A1 * | 6/2016 | Stranczl | G04B 17/285 368/127 |
| 2018/0231936 | A1 | 8/2018 | Fukuda et al. | |
| 2019/0041799 | A1 | 2/2019 | Gaugey | |
| 2020/0064776 | A1 * | 2/2020 | Heraud | G04B 15/08 |
| 2020/0064777 | A1 * | 2/2020 | Heraud | G04B 15/08 |

FOREIGN PATENT DOCUMENTS

| | | | |
|---|---|---|---|
| CN | 103261975 | A | 8/2013 |
| CN | 103309224 | A | 9/2013 |
| JP | 2013-186078 | A | 9/2013 |
| JP | 2013-545991 | A | 12/2013 |
| JP | 2014-202604 | A | 10/2014 |
| JP | 2014-202605 | A | 10/2014 |
| JP | 2015-215350 | A | 12/2015 |
| JP | 2015-219242 | A | 12/2015 |
| WO | 2017/033688 | A1 | 3/2017 |
| WO | 2017/141222 | A1 | 8/2017 |

* cited by examiner

*Primary Examiner* — Sean Kayes
(74) *Attorney, Agent, or Firm* — Harness, Dickey & Pierce, P.L.C.

(57) ABSTRACT

An escape lever suppresses energy loss and provides strong resistance to external shocks. An escape lever has a pallet fork; a pallet formed in unison with the pallet fork for engaging the escape wheel; and a pallet staff that is a pivot of the pallet fork and passes through the pallet fork. The pallet has a locking surface that the locking corner of the escape wheel contacts in the unlocking period when the escape wheel is released by the pallet and freed to move. The locking surface is shaped so that the draw angle formed by a normal to the contact point with the locking corner of the escape wheel, and a line through the contact point and the axis of the pallet staff, remains constant during the unlocking period.

9 Claims, 9 Drawing Sheets

ESCAPE LEVER, MOVEMENT, AND TIMEPIECE

This application is based upon Japanese Patent Application No. 2018-146411 filed on Aug. 3, 2018, the entire contents of which are incorporated by reference herein.

TECHNICAL FIELD

The present invention relates to an escape lever, a movement, and a timepiece.

Related Art

Timepieces having an escapement that controls the speed of escape wheel rotation by means of an escape lever are known from the literature. See, for example, JP-A-2014-202605.

In the timepiece described in JP-A-2014-202605, the locking surface of the entrance pallet is shaped so that the point of intersection between a line through the rotational axis of the escape wheel and the pivot axis of the lever, and the direction of torque transfer to the locking surface, moves from the rotational axis closer to the pivot axis, that is, the draw angle decreases, while the escape wheel turns. As a result, when the escape wheel slides against the locking surface of the entrance pallet during the unlocking period, energy loss is suppressed by reducing the torque ratio of the escape lever to the escape wheel.

However, in the timepiece described in JP-A-2014-202605, the torque ratio of the escape lever to the escape wheel gradually decreases during the unlocking period. As a result, if an external shock delays operation of the lever, and a locking corner of the escape wheel drops near the unlocking endpoint of the pallet stone, sufficient draw power cannot be achieved, and problems may result. In other words, resistance to external shock is reduced. If the minimum required moment is assured at the end of the unlocking period to prevent this problem, the moment will be greater than necessary at the beginning of the unlocking period. As a result, energy loss is increased.

SUMMARY

An escape lever according to the invention has a pallet fork; a pallet formed in unison with the pallet fork for engaging the escape wheel; and a pallet staff that is a pivot of the pallet fork and passes through the pallet fork. The pallet has a locking surface that the locking corner of the escape wheel contacts in the unlocking period when the escape wheel is released by the pallet and freed to move. The locking surface is shaped so that the draw angle formed by a normal to the contact point with the locking corner, and a line through the contact point and the axis of the pallet staff, remains constant during the unlocking period.

Preferably, the shape of the locking surface of the escape lever is curved.

In an escape lever according to another aspect of the invention, the pallet includes an entrance pallet and an exit pallet; the locking surface includes an entrance-pallet side locking surface disposed to the entrance pallet, and an exit-pallet side locking surface disposed to the exit pallet; and the entrance-pallet side locking surface and exit-pallet side locking surface are shaped so the draw angle remains constant.

In an escape lever according to another aspect of the invention, the shape of the entrance-pallet side locking surface and the exit-pallet side locking surface is curved.

In an escape lever according to another aspect of the invention, the pallet fork is formed from a material containing silicon.

An escape lever according to another aspect of the invention includes a pallet fork formed from a material containing silicon; a pallet formed in unison with the pallet fork for engaging an escape wheel; and a pallet staff that is a pivot of the pallet fork and passes through the pallet fork. The pallet has a locking surface that the locking corner of the escape wheel contacts in the unlocking period when the escape wheel is released by the pallet and freed to move. The shape of the locking surface is curved.

Another aspect of the invention is a movement comprising the escape lever described above.

Another aspect of the invention is a timepiece using the movement described above.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of the present invention is described below with reference to the accompanying figures.

Movement and Timepiece

Figure 1:
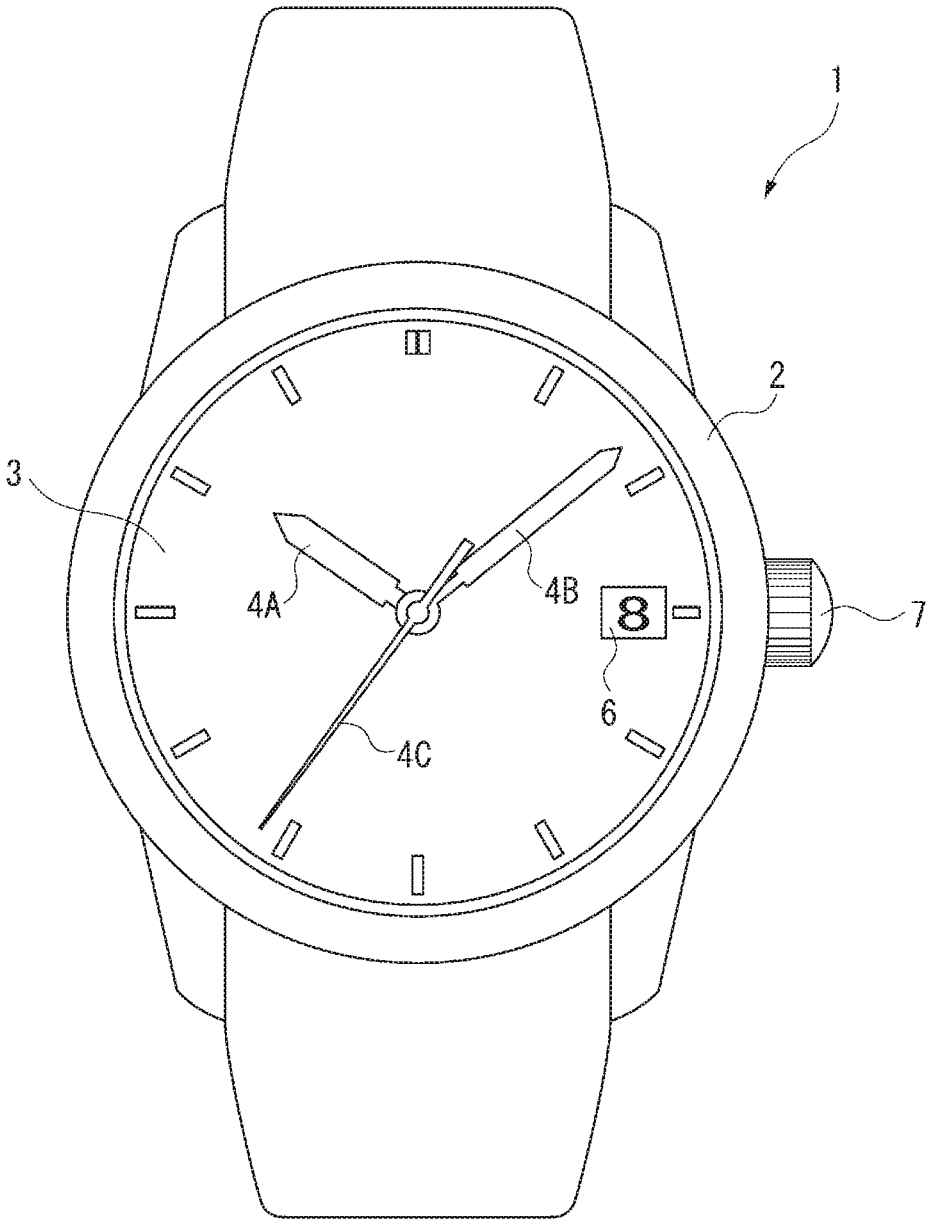
FIG. 1 is a front view of a timepiece according to a preferred embodiment of the invention.
Figure 2:
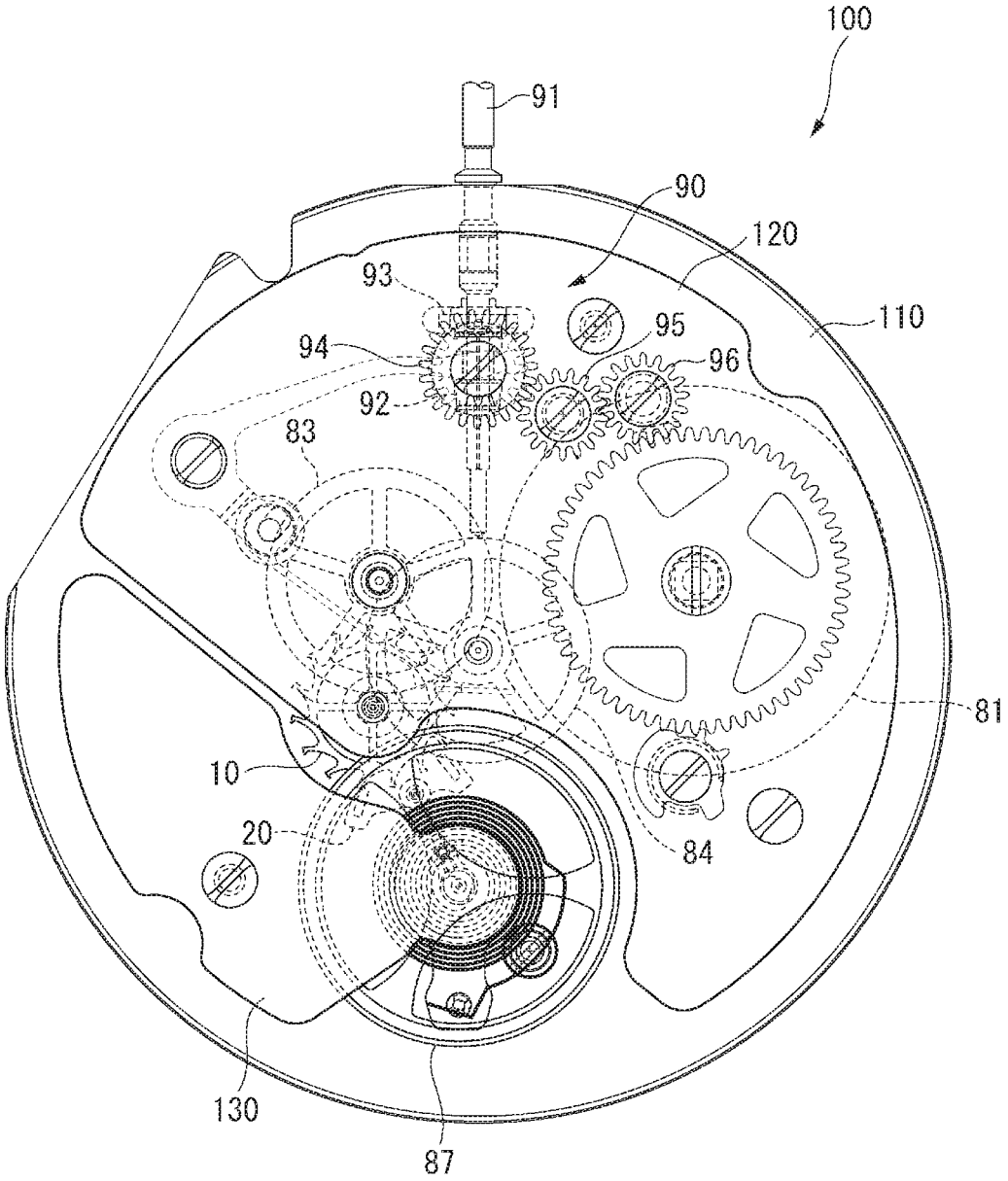
FIG. 2 illustrates the movement in this embodiment of the invention.

FIG. 1 is a front view of a timepiece 1 according to this embodiment of the invention, and FIG. 2 is a view of the movement 100 from the back cover side.

The timepiece 1 in this embodiment of the invention is a wristwatch typically worn on the user's wrist, and has a case 2, a dial 3, an hour hand 4A, a minute hand 4B, a second hand 4C, and a date wheel 6 disposed inside the case 2, and a crown 7 disposed in the side of the case 2.

The timepiece 1 also has a movement 100 held inside a case 2 as shown in FIG. 2. The movement 100 includes a main plate 110, barrel and train wheel bridge 120, and balance bridge 130.

Between the main plate 110 and barrel and train wheel bridge 120 are a barrel 81 housing a mainspring not shown, center wheel not shown, third wheel 83, fourth wheel 84, and escape wheel 10.

Located between the main plate 110 and balance bridge 130 are the escape lever 20 and balance 87. The movement 100 drives the hour hand 4A, minute hand 4B, and second hand 4C as indicators. Also disposed to the main plate 110 are two banking pins 88A and 88B as shown in FIG. 3.

The movement 100 includes a winding mechanism 90 for winding the mainspring, and the winding mechanism 90 includes a winding stem 91, sliding pinion 92, winding pinion 93, crown wheel 94, first intermediate wheel 95, and second intermediate wheel 96. As a result, rotation produced by turning the crown 7 is transferred to a ratchet wheel not shown, turns a barrel arbor not shown, and winds the mainspring. This configuration is common to mechanical timepieces, and further description thereof is omitted.

Escape Wheel

Figure 3:
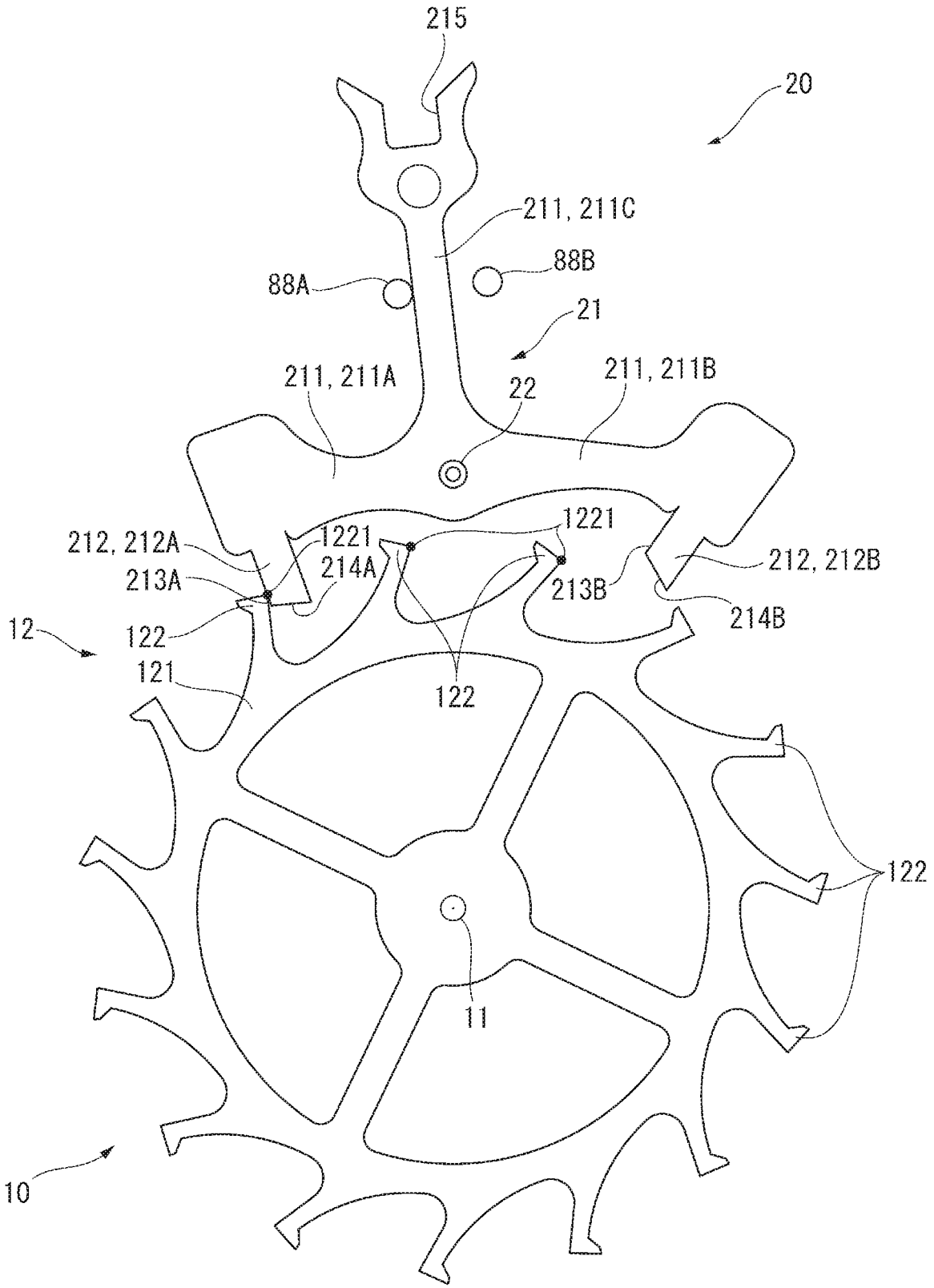
FIG. 3 is a front view of the escape wheel and escape lever in this embodiment of the invention.

FIG. 3 is a front view of the escape wheel 10 and escape lever 20.

As shown in FIG. 3, the escape wheel 10 comprises a pivot 11 and the escape wheel 12.

The escape wheel 12 has a rim 121 and multiple escape wheel teeth 122. The rim 121 is an annular part around the outside edge of the escape wheel 12. The escape wheel teeth 122 protrude to the outside from the outside circumference of the rim 121, and have a unique hook shaped configuration. At the distal end of the escape wheel teeth 122 is formed a locking corner 1221 that contacts the pallets 212 of the pallet fork 21. Note that in this embodiment of the invention the escape wheel 10 is formed from monocrystalline silicon.

Escape Lever

The escape lever 20 includes the pallet fork 21 and a pallet staff 22, which is the pivot of the pallet fork 21.

The pallet fork 21 has three pallet beams 211 including pallet arms 211A and 211B, and pallet lever 211C in a T-shaped configuration. The distal end of the pallet lever 211C is substantially U-shaped in plan view, and the space inside the U is the notch 215. The pallets 212 are formed in unison with the distal ends of the pallet arms 211A and 211B. The pallets 212 include the entrance pallet 212A disposed to the distal end of pallet arm 211A, and the exit pallet 212B disposed to the distal end of pallet arm 211B. In this embodiment of the invention the pallet fork 21 is made from a material including monocrystalline silicon The pallet staff 22 passes through the pallet fork 21, and the ends of the pallet staff 22 are supported rotatably by the main plate 110 shown in FIG. 2 and a pallet bridge not shown.

Figure 4:
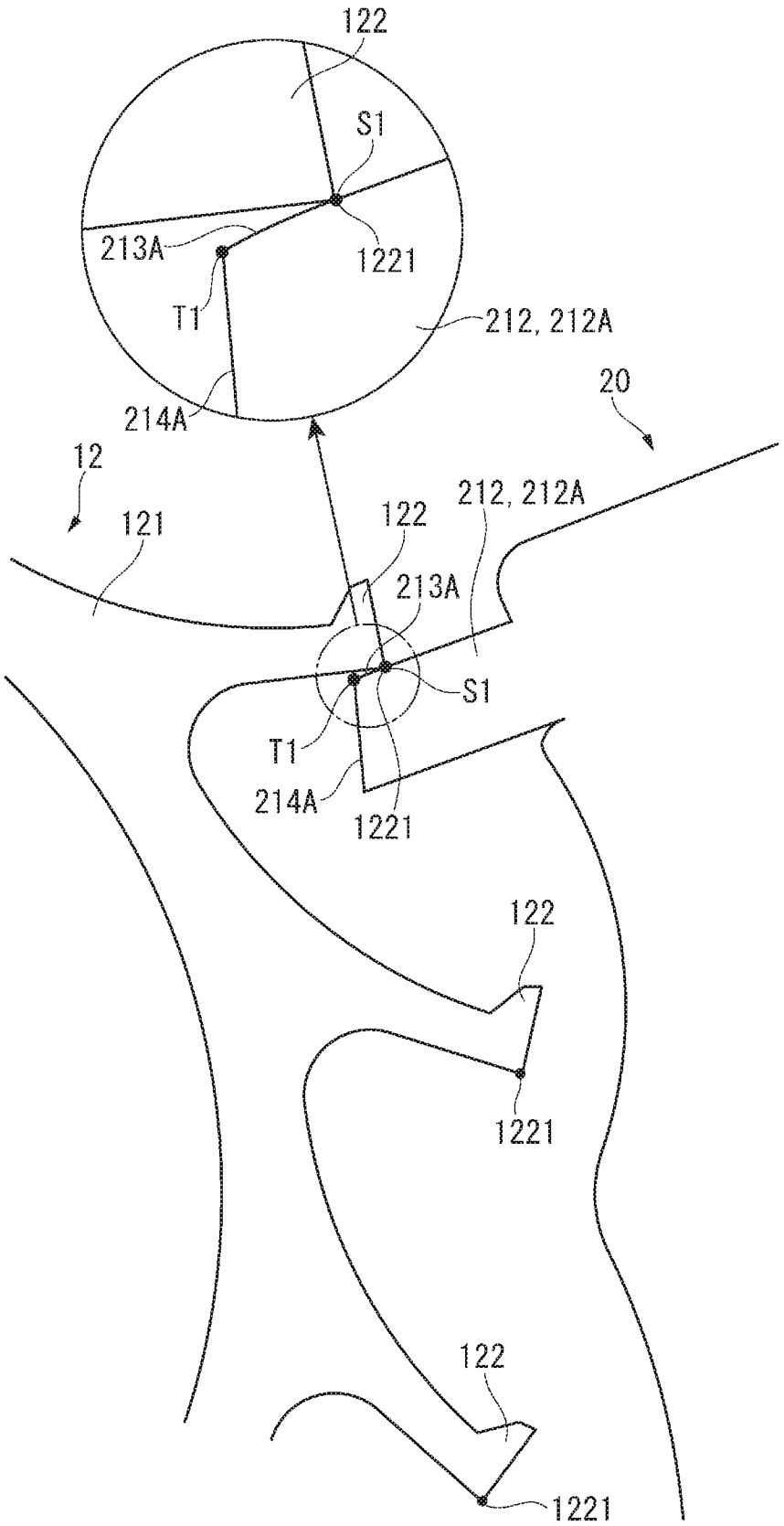
FIG. 4 is an enlarged view of the entrance pallet of the escape lever in this embodiment of the invention.
Figure 5:
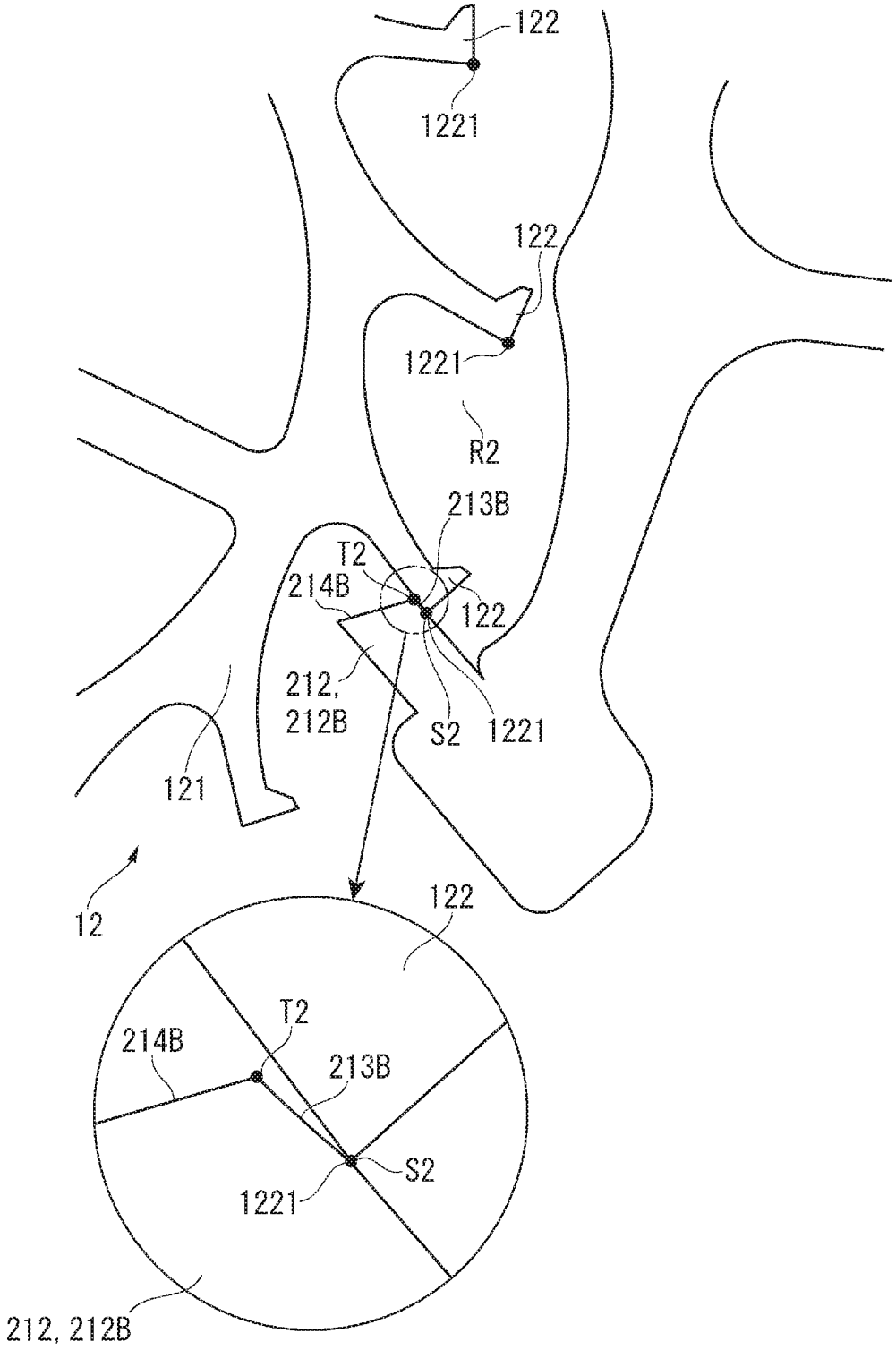
FIG. 5 is an enlarged view of the exit pallet of the escape lever in this embodiment of the invention.

FIG. 4 is an enlarged view of the entrance pallet 212A, and FIG. 5 is an enlarged view of the exit pallet 212B.

As shown in FIG. 4, the entrance pallet 212A has an entrance-pallet side locking surface 213A that contacts the locking corner 1221 of the escape wheel 12. The entrance pallet 212A also has an entrance-pallet side impulse surface 214A that intersects the entrance-pallet side locking surface 213A.

The entrance-pallet side locking surface 213A is formed with a curve bulging slightly to the outside of the entrance pallet 212A.

As shown in FIG. 5, the exit pallet 212B has an exit-pallet side locking surface 213B that contacts the locking corner 1221 of the escape wheel 12. The exit pallet 212B also has an exit-pallet side impulse surface 214B that intersects the exit-pallet side locking surface 213B.

The exit-pallet side locking surface 213B is formed with a curve that recesses slightly to the inside of the exit pallet 212B.

The entrance-pallet side locking surface 213A and exit-pallet side locking surface 213B are described in detail below.

Operation of the Entrance Pallet

The operation of the entrance pallet 212A is described next with reference to FIG. 6 and FIG. 7.

Figure 6:
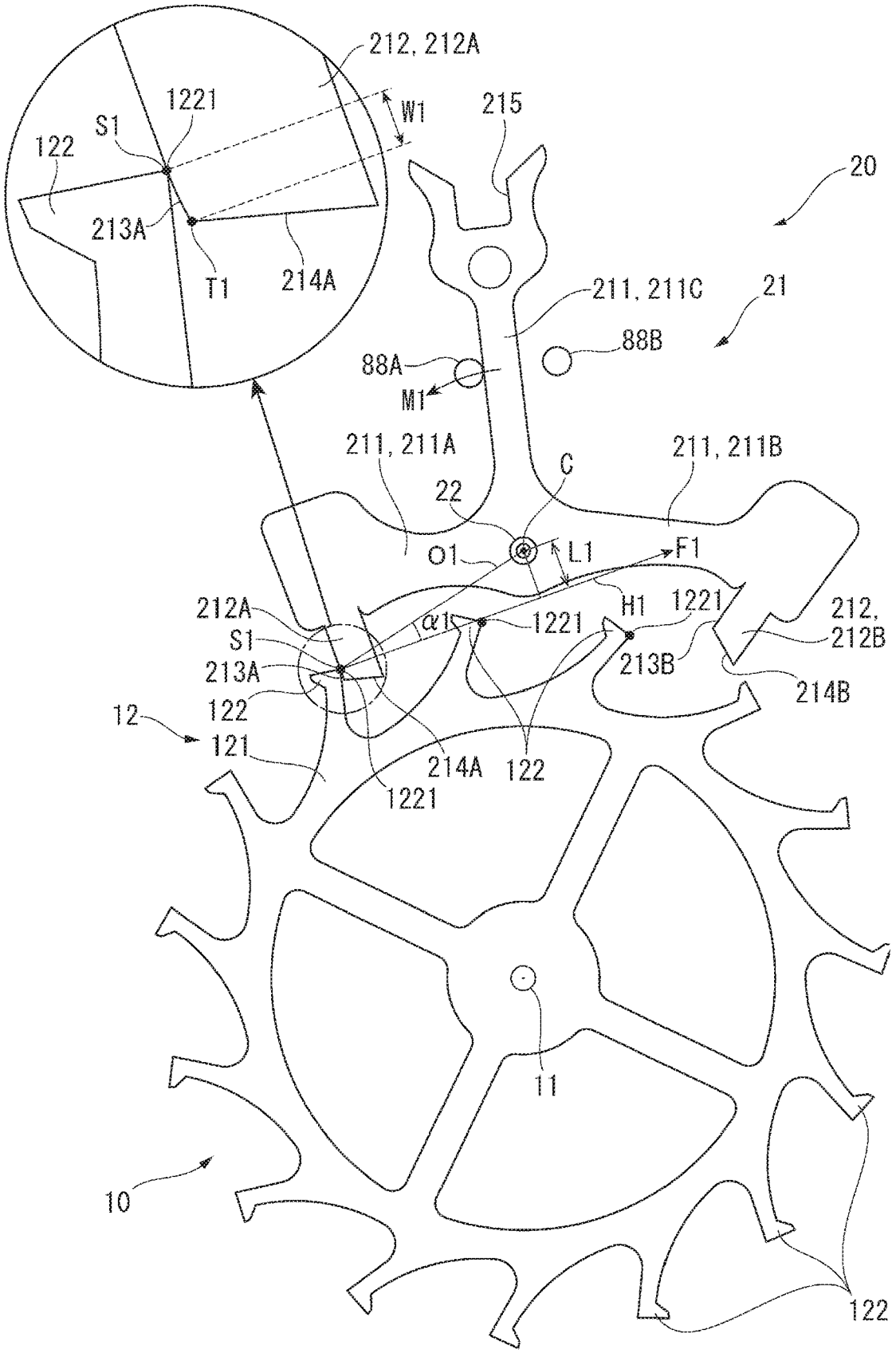
FIG. 6 is a front view showing the escape wheel and escape lever at the beginning of the entrance pallet unlocking period in this embodiment of the invention.
Figure 7:
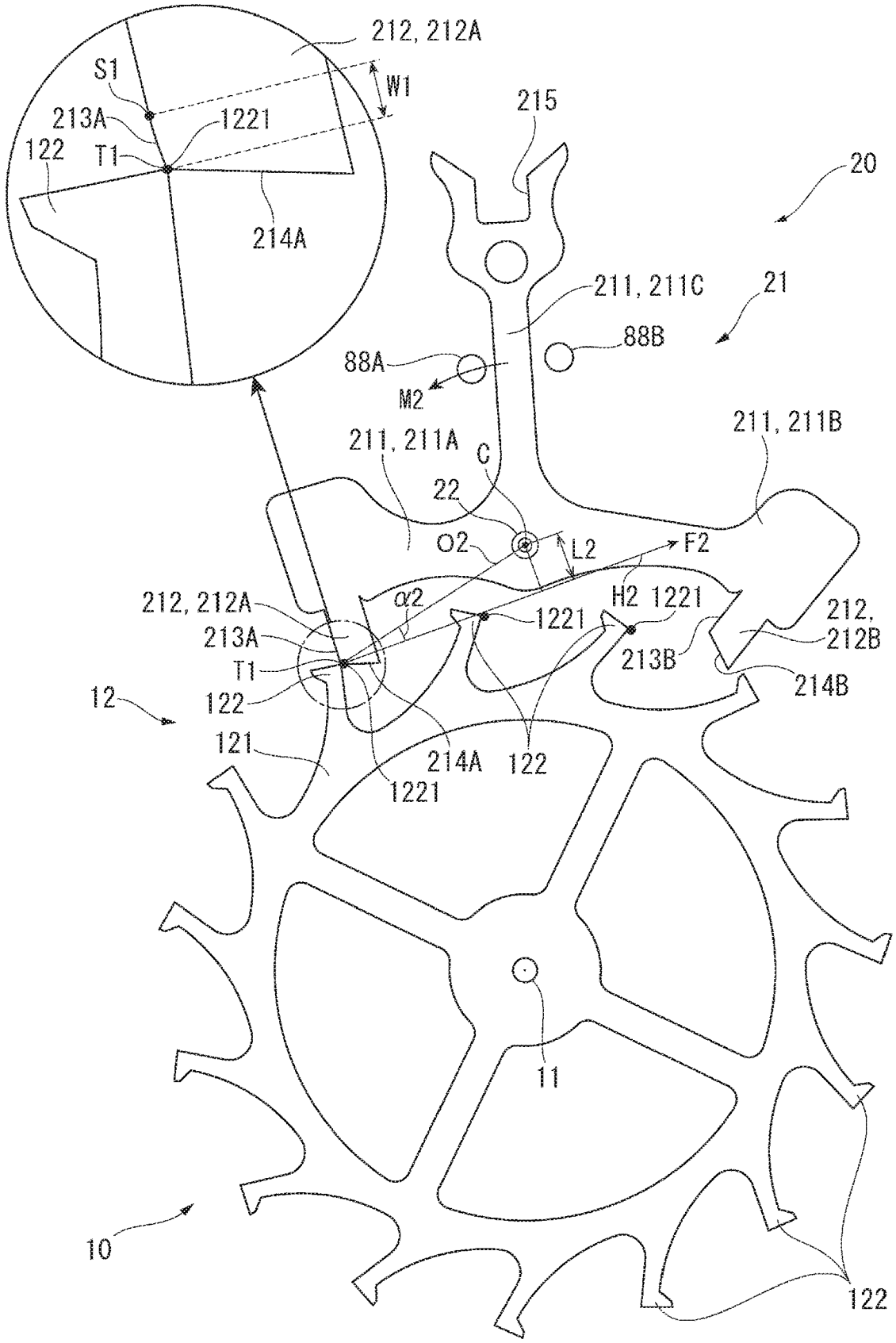
FIG. 7 is a front view showing the escape wheel and escape lever at the end of the entrance pallet unlocking period in this embodiment of the invention.

FIG. 6 shows the state at the beginning of the entrance pallet unlocking period in which the escape wheel 10 is unlocked and freed to move by the entrance pallet 212A, and FIG. 7 shows the state when the entrance pallet unlocking period ends.

The start of the entrance pallet unlocking period is when the impulse pin not shown of the balance 87 turns and contacts the inside face of the notch 215. The end of the entrance pallet unlocking period is when a locking corner 1221 of the escape wheel 12 reaches the entrance pallet unlocking end point T1 of the entrance-pallet side locking surface 213A. Note that the entrance pallet unlocking endpoint T1 is the locking corner of the entrance pallet 212A.

As shown in FIG. 6, when the entrance pallet unlocking period starts, the locking corner 1221 of the escape wheel 12 is touching the entrance pallet unlocking start position S1 of the entrance-pallet side locking surface 213A of the entrance pallet 212A. This entrance pallet unlocking start position S1 is more specifically the point of contact between the entrance-pallet side locking surface 213A and the locking corner 1221 at the start of the entrance pallet unlocking period.

At this time, the escape wheel 12 is urged to turn in the clockwise direction on the escape staff 11 by the mainspring not shown held in the barrel 81 shown in FIG. 2. As a result, the urging force produced by the mainspring works as moment M1 causing the pallet lever 211C to pivot on the axis of rotation C of the pallet staff 22. As a result, the pallet lever 211C is pushed against the left banking pin 88A disposed to the main plate 110.

Next, the impulse pin not shown of the balance 87 rotates in the clockwise direction, and pushes the inside surface of the notch 215 clockwise. As a result, the escape lever 20 rocks in the clockwise direction on the axis of rotation C of the pallet staff 22. As a result, the pallet lever 211C separates from the banking pin 88A.

In conjunction with rotation of the escape lever 20, the entrance pallet 212A rotates in the clockwise direction on the axis of rotation C of the pallet staff 22. As a result, the locking corner 1221 of the escape wheel 12 slides against the entrance-pallet side locking surface 213A. As shown in FIG. 7, at the end of the entrance pallet unlocking period, the locking corner 1221 of the escape wheel 12 moves to the entrance pallet unlocking endpoint T1. More specifically, during the entrance pallet unlocking period, the locking corner 1221 moves total locking distance W1 in contact with the entrance-pallet side locking surface 213A.

As described above, at the end of the entrance pallet unlocking period, the escape wheel 12 is urged in the clockwise direction by a mainspring not shown. As a result, the urging force from the mainspring works as moment M2 causing the pallet lever 211C to pivot on the axis of rotation C of the pallet staff 22.

Note that the entrance-pallet side locking surface 213A is an example of a locking surface the locking corner 1221 of the escape wheel 12 contacts in the accompanying claims.

Next, when the entrance pallet unlocking period ends, the locking corner 1221 of the escape wheel 12 engages the entrance-pallet side impulse surface 214A of the entrance pallet 212A. By the locking corner 1221 then sliding against the entrance-pallet side impulse surface 214A, the escape wheel 12 applies clockwise torque to the escape lever 20. As a result, torque in the counterclockwise direction is applied by the escape lever 20 to the impulse pin of the balance 87.

The escape wheel tooth 122 of the escape wheel 12 then drops from the entrance pallet 212A, and the escape wheel 12 advances one tooth in the clockwise direction.

Shape of the Entrance-Pallet Side Locking Surface

The shape of the entrance-pallet side locking surface 213A is described next with reference to FIG. 4, FIG. 6, and FIG. 7.

First, as shown in FIG. 6, draw the normal H1 to the entrance-pallet side locking surface 213A from the entrance pallet unlocking start position S1. This normal H1 is the line extending in the direction in which torque F1 is transferred from the escape wheel 12 to the entrance-pallet side locking surface 213A at the start of the entrance pallet unlocking period.

Drawing a line O1 through the axis of rotation C of the pallet staff 22 and the entrance pallet unlocking start position S1, the angle between the normal H1 and this line O1 is draw angle $\alpha$1. The distance between the normal H1 and axis of rotation C is L1.

Note that distance L1 between the normal H1 and axis of rotation C is the shortest distance between the normal H1 and axis of rotation C, and more specifically is the length of the normal from the normal H1 to axis of rotation C. This is also true of distances L2, L3, and L4 described below.

Next, as shown in FIG. 7, draw the normal H2 to the entrance-pallet side locking surface 213A from the entrance pallet unlocking end point T1. This normal H2 is the line extending in the direction in which torque F2 is transferred from the escape wheel 12 to the entrance-pallet side locking surface 213A at the end of the entrance pallet unlocking period.

Drawing a line O2 through the axis of rotation C of the pallet staff 22 and the entrance pallet unlocking end point T1, the angle between the normal H2 and this line O2 is draw angle $\alpha$2. The distance between the normal H2 and axis of rotation C is L2.

As draw angles $\alpha$1 and $\alpha$2 increase, the distances L1 and L2 between the normals H1 and H2 and the axis of rotation C also increase. Because this also increases the moment M1, M2 acting in the counterclockwise direction on the pallet lever 211C around the axis of rotation C of the pallet staff 22, rocking of the escape lever 20 becomes more difficult. The energy loss of the balance 87 therefore also increases.

However, if draw angles $\alpha$1 and $\alpha$2 are small, the distances L1 and L2 between the normals H1 and H2 and the axis of rotation C are also shorter. Because this also decreases the moment M1, M2 acting on the pallet lever 211C, the force pushing the pallet lever 211C against the banking pin 88A decreases. As a result, when an external shock or vibration is applied, the pallet lever 211C may separate from the banking pin 88A. Furthermore, if operation of the escape lever 20 is delayed, and the locking corner 1221 of the escape wheel 12 of the escape wheel 10 drops near the entrance pallet unlocking end point T1, sufficient draw cannot be obtained and other problems may result.

Therefore, draw angles $\alpha$1 and $\alpha$2 are preferably to a size that acquires the lowest required moments M1 and M2. For example, draw angles $\alpha$1 and $\alpha$2 are preferably set to approximately 10.0° to 15.0° as a size enabling producing the lowest required moments M1 and M2.

In this embodiment of the invention, the shape of the entrance-pallet side locking surface 213A is formed so that the draw angle achieves the lowest required moment in the entrance pallet unlocking period.

More specifically, the entrance pallet 212A rotates in the clockwise direction around the axis of rotation C of the pallet staff 22 during the entrance pallet unlocking period as described above. The entrance-pallet side locking surface 213A therefore also rotates clockwise. As a result, if the shape of the entrance-pallet side locking surface 213A is flat, the normal to the point of contact between the locking corner 1221 of the escape wheel 12 and the entrance-pallet side locking surface 213A will rotate in the clockwise direction around the point of contact. In this case, the draw angle $\alpha$2 at the end of the entrance pallet unlocking period will be greater than the draw angle $\alpha$1 at the start of the entrance pallet unlocking period. This means that if the lowest moment M1 required to push the pallet lever 211C against the banking pin 88A at the start of the entrance pallet unlocking period is assured, the moment M2 at the end of the entrance pallet unlocking period will be greater than necessary.

Because the entrance pallet 212A is formed in unison with the pallet fork 21, which is formed from a material containing silicon, there is no need to attach a separate pallet stone to the pallet fork 21. The pallet 212 can also be manufactured using MEMS (Micro Electro Mechanical System) technology. As a result, the shape of the entrance-pallet side locking surface 213A can be formed with great precision.

By forming the entrance pallet 212A with great precision, the entrance-pallet side locking surface 213A in this embodiment of the invention is shaped to cancel rotation of the normal in the clockwise direction. More specifically, the entrance-pallet side locking surface 213A is formed so that, in the entrance pallet unlocking period, the draw angle at the point of contact between the locking corner 1221 of the escape wheel 12 and the entrance-pallet side locking surface 213A is constant. More specifically, the entrance-pallet side locking surface 213A is formed into a curve described by a polynomial. If multiple points where the draw angle remains constant while turning the entrance pallet 212A gradually in the clockwise direction are plotted, a trend line approximating the multiple plotted points is an example of a curve described by a polynomial.

Note that the shape of the entrance-pallet side locking surface 213A is not limited to a curve described by a polynomial, and the entrance-pallet side locking surface 213A may curve along the surface of an ellipse.

This configuration enables maintaining a constant moment on the pallet lever 211C while the entrance pallet 212A turns in the entrance pallet unlocking period. Because the lowest required moment can be assured in the entrance pallet unlocking period, energy loss can be suppressed, and problems such as the pallet lever 211C separating from the banking pin 88A, and problems caused by being unable to acquire sufficient draw force, can be prevented.

Note that the draw angle being constant is not limited to the draw angle being exactly constant in the entrance pallet unlocking period, and may contain some variation in design and manufacturing tolerances. More specifically, the draw angle must at least be within a specific range in the entrance pallet unlocking period, such as in the range 12.0° to 13.0° during the entrance pallet unlocking period when the draw angle is set to 12.5°.

Operation of the Exit Pallet

The operation of the exit pallet 212B is described next with reference to FIG. 8 and FIG. 9.

Figure 8:
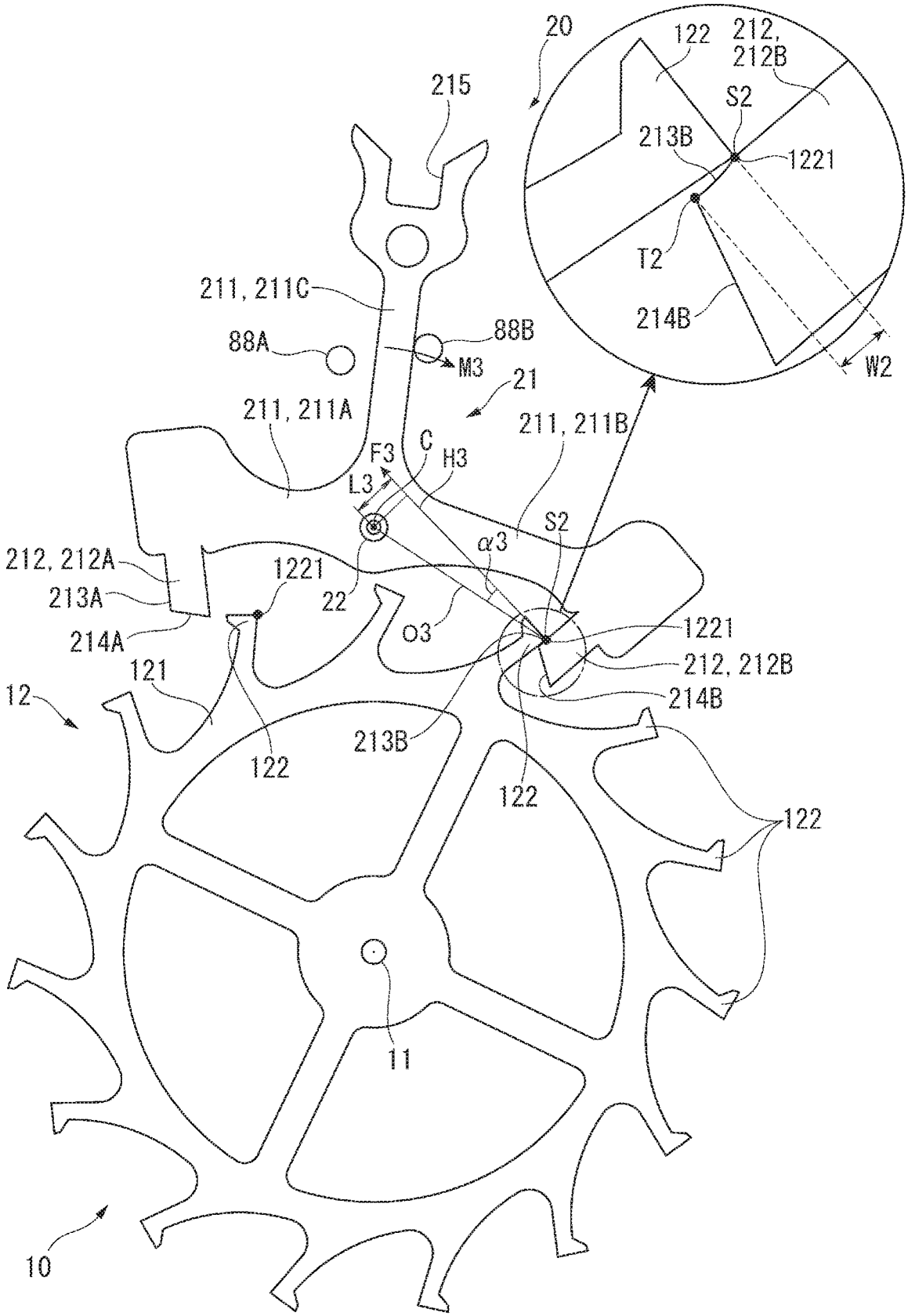
FIG. 8 is a front view showing the escape wheel and escape lever at the beginning of the exit pallet unlocking period in this embodiment of the invention.
Figure 9:
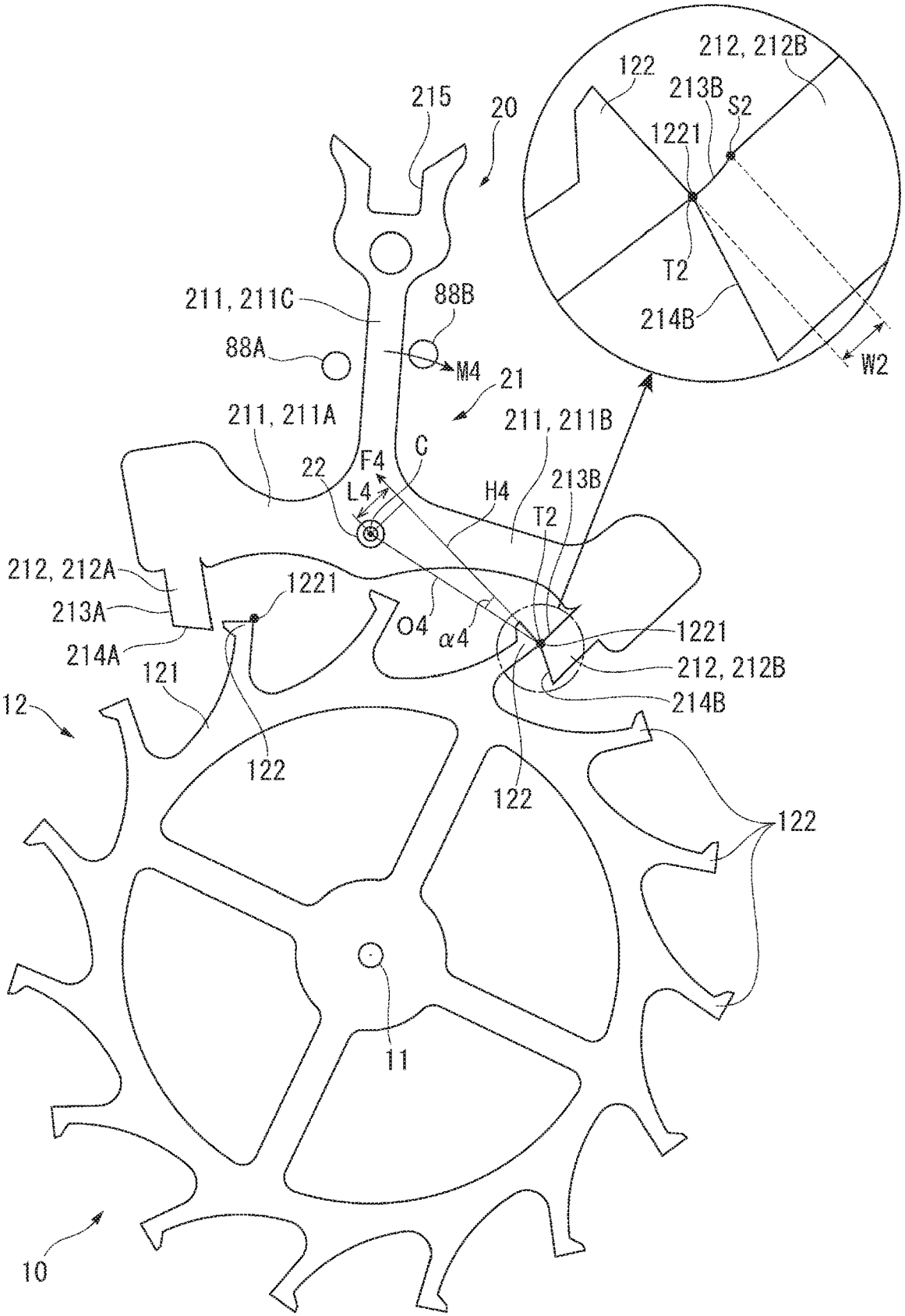
FIG. 9 is a front view showing the escape wheel and escape lever at the end of the exit pallet unlocking period in this embodiment of the invention.

FIG. 8 shows the state at the beginning of the exit pallet unlocking period in which the escape wheel 10 is unlocked and freed to move by the exit pallet 212B, and FIG. 9 shows the state when the exit pallet unlocking period ends.

The start of the exit pallet unlocking period is when the impulse pin not shown of the balance 87 turns and contacts the inside face of the notch 215. The end of the exit pallet unlocking period is when the locking corner 1221 of the escape wheel 12 reaches the exit pallet unlocking end point T2 of the exit-pallet side locking surface 213B. Note that the exit pallet unlocking endpoint T2 is the locking corner of the exit pallet 212B.

As shown in FIG. 8, when the exit pallet unlocking period starts, the locking corner 1221 of the escape wheel 12 is touching the exit pallet unlocking start position S2 of the exit-pallet side locking surface 213B of the exit pallet 212B. As described above, the escape wheel 12 is urged in the clockwise direction at this time. As a result, the urging force produced by the mainspring works as moment M3 causing the pallet lever 211C to pivot on the axis of rotation C of the pallet staff 22. As a result, the pallet lever 211C is pushed against the right banking pin 88B.

Next, the impulse pin not shown of the balance 87 rotates in the counterclockwise direction, and pushes the inside surface of the notch 215 counterclockwise. As a result, the escape lever 20 rocks in the counterclockwise direction on the axis of rotation C of the pallet staff 22. As a result, the pallet lever 211C separates from the banking pin 88B.

The exit pallet 212B also rotates in the counterclockwise direction on the axis of rotation C of the pallet staff 22. As a result, the locking corner 1221 of the escape wheel 12 slides against the exit-pallet side locking surface 213B.

As shown in FIG. 9, at the end of the exit pallet unlocking period, the locking corner 1221 of the escape wheel 12 moves to the exit pallet unlocking end point T2. More specifically, during the exit pallet unlocking period, the locking corner 1221 moves total locking distance W2 in contact with the exit-pallet side locking surface 213B.

As described above, at the end of the exit pallet unlocking period, the escape wheel 12 is urged in the clockwise direction by a mainspring not shown. As a result, the urging force from the mainspring works as moment M4 causing the pallet lever 211C to pivot on the axis of rotation C of the pallet staff 22.

Note that the exit-pallet side locking surface 213B is an example of a locking surface the locking corner 1221 of the escape wheel 12 contacts in the accompanying claims.

Next, when the exit pallet unlocking period ends, the locking corner 1221 of the escape wheel 12 engages the exit-pallet side impulse surface 214B of the exit pallet 212B. By the locking corner 1221 then sliding against the exit-pallet side impulse surface 214B, the escape wheel 12 applies counterclockwise torque to the escape lever 20. As a result, torque in the counterclockwise direction is applied through the escape lever 20 to the impulse pin of the balance 87.

The escape wheel tooth 122 of the escape wheel 12 then drops from the exit pallet 212B, and the escape wheel 12 advances one tooth in the clockwise direction.

Shape of the Exit-Pallet Side Locking Surface

The shape of the exit-pallet side locking surface 213B is described next with reference to FIG. 5, FIG. 8, and FIG. 9.

First, as shown in FIG. 8, draw the normal H3 to the exit-pallet side locking surface 213B from the exit pallet unlocking start position S2. This normal H3 is a line extending in the direction in which torque F3 is transferred from the escape wheel 12 to the exit-pallet side locking surface 213B at the start of the exit pallet unlocking period.

Drawing a line O3 through the axis of rotation C of the pallet staff 22 and the exit pallet unlocking start position S2, the angle between the normal H3 and this line O3 is draw angle $\alpha$3. The distance between the normal H3 and axis of rotation C is L3.

Next, as shown in FIG. 9, draw the normal H4 to the exit-pallet side locking surface 213B from the exit pallet unlocking end point T2. This normal H4 is the line extending in the direction in which torque F4 is transferred from the escape wheel 12 to the exit-pallet side locking surface 213B at the end of the exit pallet unlocking period.

Drawing a line O4 through the axis of rotation C of the pallet staff 22 and the exit pallet unlocking end point T2, the angle between the normal H4 and this line O4 is draw angle $\alpha$4. The distance between the normal H4 and axis of rotation C is L4.

As described above, the exit pallet 212B turns counterclockwise in the exit pallet unlocking period. In conjunction therewith, the exit-pallet side locking surface 213B also turns counterclockwise.

As a result, if the shape of the exit-pallet side locking surface 213B is flat, the normal to the point of contact between the locking corner 1221 of the escape wheel 12 and the exit-pallet side locking surface 213B will rotate in the counterclockwise direction around the point of contact. In this case, the draw angle $\alpha$4 at the end of the exit pallet unlocking period will be smaller than the draw angle $\alpha$3 at the start of the exit pallet unlocking period. This means that if the lowest moment M4 required at the end of the exit pallet unlocking period is assured, the moment M3 at the start of the exit pallet unlocking period will be greater than necessary.

Draw angles $\alpha$1 and $\alpha$4 are therefore preferably set so that the lowest required moments M3, M4 can be acquired. For example, the draw angles $\alpha$1 and $\alpha$4 are preferably set to approximately 10.0° to 15.0° so that the lowest required moments M3, M4 can be achieved.

Because the exit pallet 212B is formed in unison with the pallet fork 21, which is formed from a material containing silicon, the shape of the exit-pallet side locking surface 213B can be formed with great precision.

By forming the exit pallet 212B with great precision, the exit-pallet side locking surface 213B in this embodiment of the invention is shaped to cancel rotation of the normal in the counterclockwise direction. More specifically, the exit-pallet side locking surface 213B is formed so that, in the exit pallet unlocking period, the draw angle at the point of contact between the locking corner 1221 of the escape wheel 12 and the exit-pallet side locking surface 213B is constant.

More specifically, like the entrance-pallet side locking surface 213A described above, the exit-pallet side locking surface 213B is formed into a curve described by a polynomial.

Note that the shape of the exit-pallet side locking surface 213B is not limited to a curve described by a polynomial, and the exit-pallet side locking surface 213B may curve along the surface of an ellipse.

This configuration enables maintaining a constant moment on the pallet lever 211C while the exit pallet 212B turns in the exit pallet unlocking period. Because the lowest required moment can be assured in the exit pallet unlocking period, energy loss can be suppressed, and problems such as the pallet lever 211C separating from the banking pin 88B, and problems caused by being unable to acquire sufficient draw force, can be prevented.

Note that the draw angle being constant is not limited to the draw angle being exactly constant in the exit pallet unlocking period, and may contain some variation in design and manufacturing tolerances. More specifically, the draw angle must at least be within a specific range in the exit pallet unlocking period.

Operating Effect

The operating effect of this embodiment of the invention is described below.

The escape lever 20 includes a pallet fork 21 made from a material containing silicon, and an entrance pallet 212A that is formed in unison with the pallet fork 21 and engages the escape wheel 10. The shape of the entrance-pallet side locking surface 213A of the entrance pallet 212A can therefore be formed with great precision. As a result, the entrance-pallet side locking surface 213A can be formed to a shape whereby the draw angle is constant at the contact point between the entrance-pallet side locking surface 213A and the locking corner 1221 of the escape wheel 12 during the entrance pallet unlocking period.

The minimum required moment can therefore be assure during the entrance pallet unlocking period, energy loss can be suppressed, and resistance to external shocks can be increased.

Because the entrance-pallet side locking surface 213A in this embodiment of the invention is formed to a curved surface described by a polynomial, the locking corner 1221 of the escape wheel 12 can move smoothly from the entrance pallet unlocking start position S1 to the entrance pallet unlocking end point T1. As a result, energy loss can be suppressed during the entrance pallet unlocking period.

The escape lever 20 includes an exit pallet 212B that is formed in unison with the pallet fork 21 and engages the escape wheel 10. The shape of the exit-pallet side locking surface 213B of the exit pallet 212B can therefore be formed with great precision. As a result, the exit-pallet side locking surface 213B can be formed to a shape whereby the draw angle is constant at the contact point between the exit-pallet side locking surface 213B and the locking corner 1221 of the escape wheel 12 during the exit pallet unlocking period.

The minimum required moment can therefore be assure during the exit pallet unlocking period, energy loss can be suppressed, and resistance to external shocks can be increased.

Because the exit-pallet side locking surface 213B in this embodiment of the invention is formed to a curved surface described by a polynomial, the locking corner 1221 of the escape wheel 12 can move smoothly from the exit pallet unlocking start position S2 to the exit pallet unlocking end point T2. As a result, energy loss can be suppressed during the entrance pallet unlocking period.

Other Embodiments

The invention is not limited to the foregoing embodiment, and includes modifications and improvements that can be achieved within the scope of changes enabling achieving the objective of the invention.

The entrance-pallet side locking surface 213A in the foregoing embodiment is formed as a curved surface following a curve described by a polynomial, but the invention is not so limited. For example, the entrance-pallet side locking surface may be formed like a staircase with multiple steps. In other words, the entrance-pallet side locking surface may be formed to any shape whereby the draw angle at the contact point with the locking corner is within a specific range during the entrance pallet unlocking period.

Likewise, the exit-pallet side locking surface 213B in the foregoing embodiment is formed as a curved surface following a curve described by a polynomial, but is not so limited and may be formed to any shape whereby the draw angle at the contact point with the locking corner is within a specific range during the exit pallet unlocking period.

In the foregoing embodiment, the entrance-pallet side locking surface 213A and exit-pallet side locking surface 213B are formed to shapes maintaining a constant draw angle at the point of contact with the locking corner 1221 during the unlocking period, but the invention is not so limited. For example, a configuration in which only one of the entrance-pallet side locking surface and exit-pallet side locking surface is formed to a shape maintaining a constant draw angle at the point of contact with the locking corner 1221 during the unlocking period is also conceivable.

In the embodiment described above the entrance pallet 212A and exit pallet 212B are formed in unison with the pallet fork 21, but the invention is not so limited. For example, three or more pallets may be formed with the pallet fork.

In the embodiment described above the pallet fork 21 is formed from a material containing monocrystalline silicon, but the invention is not so limited. For example, the pallet fork may be formed from a material containing monocrystalline silicon and carbon.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An escape lever comprising:

an escape wheel having a plurality of escape wheel teeth, each of the plurality of escape wheel teeth having a locking corner;

a pallet fork including an entrance pallet and an exit pallet, the entrance pallet having a first locking surface, the exit pallet having a second locking surface, each of the first locking surface and the second locking surface being selectively contacted with a corresponding one of the locking corners of the escape wheel at a contact point during an unlocking period in which the escape wheel is released from a locking state of the escape wheel; and a pallet staff pivotably connected to the pallet fork via a pivot axis, wherein a first draw angle is formed between a first normal to the first locking surface at the contact point and a first line connecting between the contact point on the first locking surface and the pivot axis, a second draw angle is formed between a second normal to the second locking surface at the contact point and a second line connecting between the contact point on the second locking surface and the pivot axis, the first draw angle is constant during the unlocking period with respect to the entrance pallet, and the second draw angle is constant during the unlocking period with respect to the exit pallet, and each of the first and second draw angles is in a range 10.0° to 15.0°.

2. The escape lever described in claim 1, wherein each of the first and second locking surfaces is curved.

3. The escape lever described in claim 1, wherein the pallet fork contains silicon.

4. A movement comprising:

a plurality of wheels engaged one another, the plurality of wheels including an escape wheel; and an escape lever, the escape lever including:

the escape wheel having a plurality of escape wheel teeth, each of the plurality of escape wheel teeth having a locking corner;

a pallet fork including an entrance pallet and an exit pallet, the entrance pallet having a first locking surface, the exit pallet having a second locking surface, each of the first locking surface and the second locking surface being selectively contacted with a corresponding one of the locking corners of the escape wheel at a contact point during an unlocking period in which the escape wheel is released from a locking state of the escape wheel; and a pallet staff pivotably connected to the pallet fork via a pivot axis, wherein a first draw angle is formed between a first normal to the first locking surface at the contact point and a first line connecting between the contact point on the first locking surface and the pivot axis, a second draw angle is formed between a second normal to the second locking surface at the contact point and a second line connecting between the contact point on the second locking surface and the pivot axis, the first draw angle is constant during the unlocking period with respect to the entrance pallet, and the second draw angle is constant during the unlocking period with respect to the exit pallet, and each of the first and second draw angles is in a range of 10.0° to 15.0°.

5. The movement according to claim 4, wherein each of the first and second locking surfaces is curved.

6. The movement according to claim 4, wherein the pallet fork contains silicon.

7. A timepiece comprising:

a case;

a plurality of wheels housed in the case, the plurality of wheel being engaged one another, the plurality of wheels including an escape wheel; and an escape lever housed in the case, the escape lever including:

the escape wheel having a plurality of escape wheel teeth, each of the plurality of escape wheel teeth having a locking corner;

a pallet fork, including an entrance pallet and an exit pallet, the entrance pallet having a first locking surface, the exit pallet having a second locking surface, each of the first locking surface and the second locking surface being selectively contacted with a corresponding one of the locking corners of the escape wheel at a contact point during an unlocking period in which the escape wheel is released from a locking state of the escape wheel; and a pallet staff pivotably connected to the pallet fork via a pivot axis, wherein a first draw angle is formed between a first normal to the first locking surface at the contact point and a first line connecting between the contact point on the first locking surface and the pivot axis, a second draw angle is formed between a second normal to the second locking surface at the contact point and a second line connecting between the contact point on the second locking surface and the pivot axis, the first draw angle is constant during the unlocking period with respect to the entrance pallet, and the second draw angle is constant during the unlocking period with respect to the exit pallet, and each of the first and second draw angles is in a range of 10.0° to 15.0°.

8. The timepiece according to claim 7, wherein each of the first and second locking surfaces is curved.

9. The timepiece according to claim 7, wherein the pallet fork contains silicon.

* * * * *